US010626705B2

(12) United States Patent
Ewing et al.

(10) Patent No.: US 10,626,705 B2
(45) Date of Patent: Apr. 21, 2020

(54) MAGNETIC PULSE ACTUATION ARRANGEMENT HAVING LAYER AND METHOD

(71) Applicants: Daniel Ewing, Katy, TX (US); Carlos Antonio Prieto, Katy, TX (US); Christopher Ryan Hern, Porter, TX (US)

(72) Inventors: Daniel Ewing, Katy, TX (US); Carlos Antonio Prieto, Katy, TX (US); Christopher Ryan Hern, Porter, TX (US)

(73) Assignee: BAER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/893,237

(22) Filed: Feb. 9, 2018

(65) Prior Publication Data

US 2019/0249522 A1 Aug. 15, 2019

(51) Int. Cl.

| | |
|---|---|
| ***E21B 28/00*** | (2006.01) |
| ***E21B 41/00*** | (2006.01) |
| ***H01F 7/06*** | (2006.01) |
| ***H01F 27/28*** | (2006.01) |
| ***H01F 7/16*** | (2006.01) |
| *E21B 43/10* | (2006.01) |
| *E21B 33/12* | (2006.01) |
| *E21B 31/06* | (2006.01) |
| *E21B 23/01* | (2006.01) |

(52) U.S. Cl.

CPC ..... *E21B 41/00* (2013.01); *H01F 7/064* (2013.01); *H01F 7/16* (2013.01); *H01F 27/28* (2013.01); *E21B 23/01* (2013.01); *E21B 31/06* (2013.01); *E21B 33/12* (2013.01); *E21B 43/108* (2013.01)

(58) Field of Classification Search

CPC ..... E21B 28/00

See application file for complete search history.

(56) References Cited

U.S. PATENT DOCUMENTS 3,810,372 A 5/1974 Queyroix
4,255,975 A * 3/1981 Debreuille ..... E21B 47/00 33/313

(Continued)

FOREIGN PATENT DOCUMENTS

GB 1383605 A 2/1974
KR 101529700 B1 6/2015

(Continued)

OTHER PUBLICATIONS

Arumugam, et al.; "Experimental Study of Electromagnetic Sheet Metal Forming Process", 12th Global Congress on Manufacutring & Management, Procedia Engineering 97 (2014) pp. 277-290; 14 pages total.

(Continued)

*Primary Examiner* — Kenneth L Thompson
(74) *Attorney, Agent, or Firm* — Cantor Colburn LLP

(57) ABSTRACT

A magnetic pulse actuation arrangement configured for use in a downhole system, the arrangement including: a workpiece; a layer placed on a portion of the workpiece, the layer having a different magnetic permeability than the workpiece; and, an inductor including a coil and configured to deliver a magnetic pulse to the workpiece to urge the workpiece in a direction, the layer facing the coil.

20 Claims, 5 Drawing Sheets

(56) References Cited

U.S. PATENT DOCUMENTS

| | | | | |
|---|---|---|---|---|
| 4,619,127 | A | 10/1986 | Sano et al. | |
| 4,825,954 | A | 5/1989 | Baugh | |
| 5,030,873 | A * | 7/1991 | Owen | B06B 3/00 310/26 |
| 5,188,177 | A | 2/1993 | Curry | |
| 5,826,320 | A | 10/1998 | Rathke et al. | |
| 5,955,934 | A | 9/1999 | Raj | |
| 6,474,534 | B2 | 11/2002 | Gabbianelli et al. | |
| 7,199,480 | B2 * | 4/2007 | Fripp | E21B 41/0085 290/1 R |
| 7,301,429 | B1 | 11/2007 | Hall et al. | |
| 8,662,169 | B2 | 3/2014 | Cortez | |
| 9,476,277 | B2 | 10/2016 | Stamatakis | |
| 10,227,860 | B1 * | 3/2019 | McMullen | E21B 4/04 |
| 2004/0079524 | A1 | 4/2004 | Bass et al. | |
| 2004/0084381 | A1 | 5/2004 | Korenev | |
| 2004/0084442 | A1 | 5/2004 | Larovere | |
| 2004/0263004 | A1 * | 12/2004 | Krokoszinski | F16K 31/04 310/14 |
| 2005/0097934 | A1 | 5/2005 | Park | |
| 2006/0081684 | A1 | 4/2006 | Moore | |
| 2006/0131300 | A1 | 6/2006 | Yablochnikov | |
| 2008/0061789 | A1 | 3/2008 | Coates et al. | |
| 2009/0085701 | A1 | 4/2009 | Veneruso et al. | |
| 2009/0166045 | A1 * | 7/2009 | Wetzel | E21B 41/0085 166/381 |
| 2010/0000742 | A1 | 1/2010 | Bonner et al. | |
| 2012/0169334 | A1 | 7/2012 | Hopper et al. | |
| 2014/0238662 | A1 | 8/2014 | Prieto | |
| 2014/0239957 | A1 | 8/2014 | Zhang et al. | |
| 2014/0328139 | A1 * | 11/2014 | Minto | G01V 1/02 367/25 |
| 2015/0159475 | A1 | 6/2015 | Prieto et al. | |
| 2015/0308228 | A1 | 10/2015 | Vick, Jr. et al. | |
| 2015/0328712 | A1 | 11/2015 | Grubb | |
| 2016/0040506 | A1 | 2/2016 | Goodman et al. | |
| 2016/0097268 | A1 | 4/2016 | Okoniewski et al. | |
| 2016/0175980 | A1 | 6/2016 | Golovashchenko et al. | |
| 2017/0266752 | A1 | 9/2017 | Apel et al. | |
| 2018/0038972 | A1 * | 2/2018 | Gresillon | G01V 1/143 |
| 2018/0043463 | A1 | 2/2018 | Prieto et al. | |
| 2018/0045006 | A1 * | 2/2018 | Prieto | E21B 23/00 |
| 2018/0045007 | A1 * | 2/2018 | Prieto | B21D 26/14 |
| 2018/0080296 | A1 * | 3/2018 | Prieto | E21B 43/10 |
| 2018/0188413 | A1 | 7/2018 | Capoglu et al. | |

FOREIGN PATENT DOCUMENTS

| | | | |
|---|---|---|---|
| WO | 0181021 | A2 | 11/2001 |
| WO | 2007132468 | A1 | 11/2007 |
| WO | 2010135492 | A2 | 11/2010 |

OTHER PUBLICATIONS

Bay, et al.; "Electromagnetic forming processes: material behaviour and computational modelling"; 11th International Conference on Technology, Nagoya, Japan; Procedia Engineering 81 (2014) 793-800, 8 pages total.

Buckley "An introduction to Eddy Current Testing theory and technology" technical paper eddyc.pdf available from the internet at http://joe.buckley.net/papers; Sep. 8 2003 (pp. 1-7).

Gayakwad, et al.; "A Review on Electromagnetic Forming Process"; 3rd International Conference on Materials Processing and Characterisation; Procedia Materials Science 6 (2014) 520-527, 8 pages total.

Kinsey, et al. "Electromagnetic forming and Joining of Dissimilar Materials"; I/URC for Metal Deformatin Processes Planning Meeting, Evanston, IL; Mar. 14-15, 2017; 10 pages.

Miranda et al. "Magnetic pulse welding on the cutting edge of industrial applications." Soldagem & Inspeçã 19.1 (2014): 69-81.

Notification of Transmittal of the International Search Report and the Written Opinion of the International Searching Authority, or the Declaration; PCT/US2017/046289; dated Nov. 20, 2017 (pp. 1-9).

Notification of Transmittal of the International Search Report and the Written Opinion of the International Searching Authority, or the Declaration; PCT/US2017/046296; dated Nov. 22, 2017; 10 pages.

Notification of Transmittal of the International Search Report and the Written Opinion of the International Searching Authority, or the Declaration; PCT/US2017/046298; dated Nov. 22, 2017; 12 pages.

Notification of Transmittal of the International Search Report and the Written Opinion of the International Searching Authority, or the Declaration; PCT/US2017/047507; dated Oct. 31, 2017; 8 pages.

Otin, et al., "A Frequency Domain Approach for Computing the Lorentz Force in Electromagnetic Metal Forming"; International Center for Numerical Methods in Enginnering; 2004-2007; 50 pages.

Otin, et al., "Electromagnetic Metal Forming"; CIMNE—International Center for Numerical Methods in Engineering, Barcelona, Spain; Jul. 2011; 37 pages.

Popovic, et al. Introductory Electromagnetics; Chapter 20—Skin Effects, p. 382-392; Prentice Hall (2000).

Psyk, et al., "Electromagnetic forming—A review"; Journal of Materials Processing Technology 211 (2011) pp. 787-829.

Psyk, et al.; "Process Model and Design for Magnetic Pulse Welding by Tube Expansion"; 5th Internatational Conference on High Speed Forming, 2012; 10 pages.

Senthilnathan, et al.; "A two stage finite element analysis of electromagnetic forming of perforated aluminium sheet metals"; 12th Global Congress on Manufacturing and Management; Procedia Engineering 97 (2014) 1135-1144; 10 pages total.

Yu "Effects of current frequency on electromagnetic tube compression"; Journal of Materials Processing Technology, Jan. 2009; 8 pages.

* cited by examiner

MAGNETIC PULSE ACTUATION ARRANGEMENT HAVING LAYER AND METHOD

BACKGROUND

In the resource recovery industry, resources are often recovered from boreholes in formations containing the targeted resource. A plethora of tools are used in such operations, many of them needing to be actuated remotely. While early actuation configurations comprised mechanical connections only, more recent configurations employ chemical, electrical and mechanical means as well as combinations thereof. The industry has many available configurations and methods but due to evolving conditions and recovery concepts, the industry is always in search of alternate configurations and methods to actuate the various tools that are used.

SUMMARY

A magnetic pulse actuation arrangement configured for use in a downhole system, the arrangement including: a workpiece; a layer placed along a portion of the workpiece, the layer having a different magnetic permeability than the workpiece; and, an inductor including a coil and configured to deliver a magnetic pulse to the workpiece to urge the workpiece in a direction, the layer facing the coil.

A method of installing a workpiece in a downhole system, the method including: selectively applying a layer to a portion of the workpiece, the layer having a greater magnetic permeability than the workpiece; running the workpiece to a target location with respect to a downhole structure; creating a magnetic pulse using an inductor, the layer facing the inductor; and urging the workpiece in a direction relative to a structure with the magnetic pulse.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
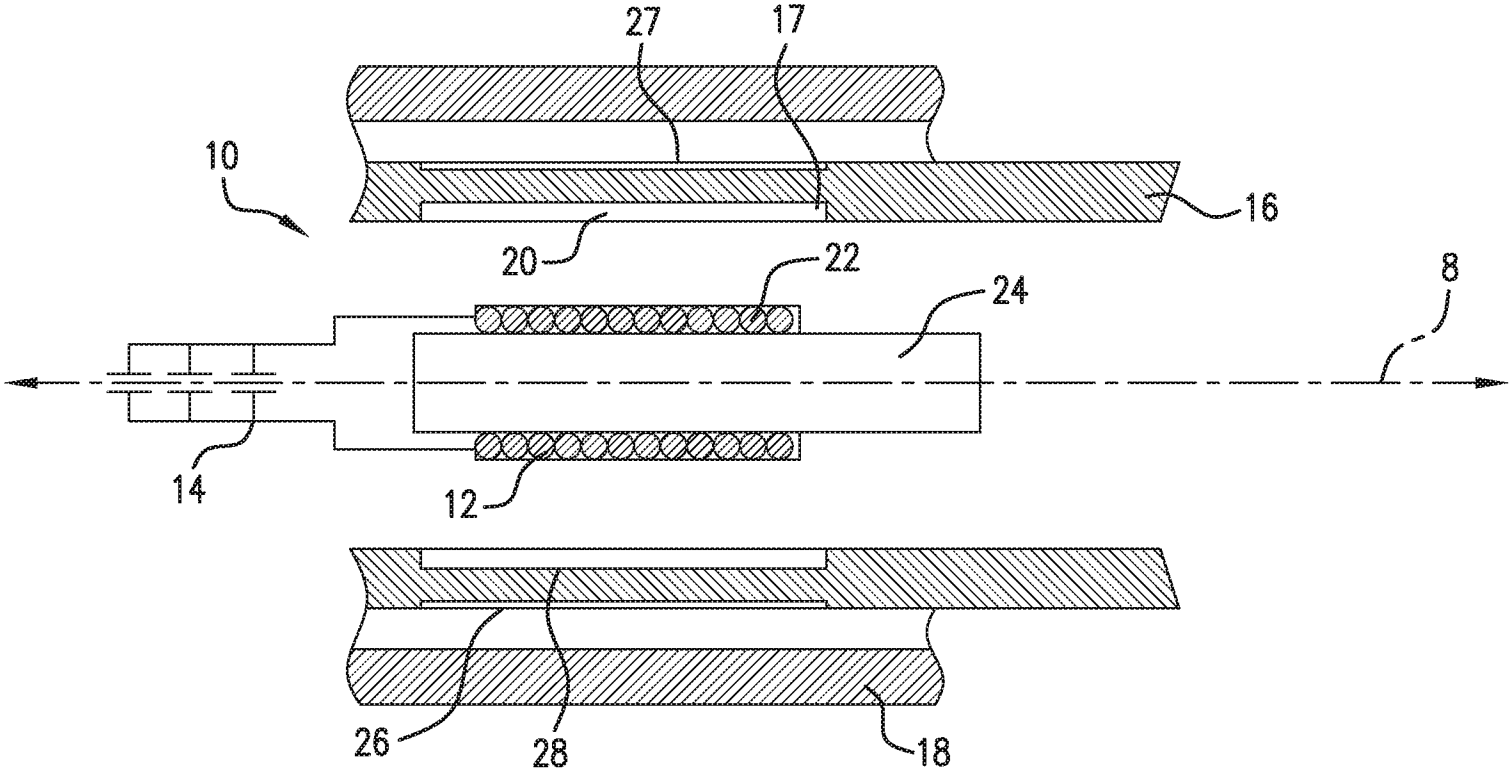
FIG. 1 depicts a sectional schematic view of an embodiment of a magnetic pulse actuation arrangement having a layered workpiece.

Referring to FIG. 1, one embodiment of a magnetic pulse actuation arrangement 10 is illustrated. The arrangement 10 includes an inductor 12, which in the illustrated embodiment includes a coil 22 wrapped around a mandrel 24. The mandrel 24 extends along a longitudinal axis 8. The inductor 12 is fed by a capacitor 14. The capacitor 14 may be a source of electrical energy or may be used to condition electrical energy from another source such as a battery (not shown) or cable from a more remote location (not shown). A workpiece 16, which includes any tool and more particularly any downhole tool such as the illustrated tubular, is disposed near the inductor 12 such that a magnetic field produced by the inductor 12 is coupled to the workpiece 16 generating a magnetic pulse to move the workpiece 16. The magnitude of the magnetic pulse is proportionally related to the current applied to the inductor 12. The velocity of movement of the workpiece 16 under the influence of the magnetic pulse may be at a minimum velocity, and in some embodiments may be, but not limited to, approximately 200 meters per second.

Figure 2:
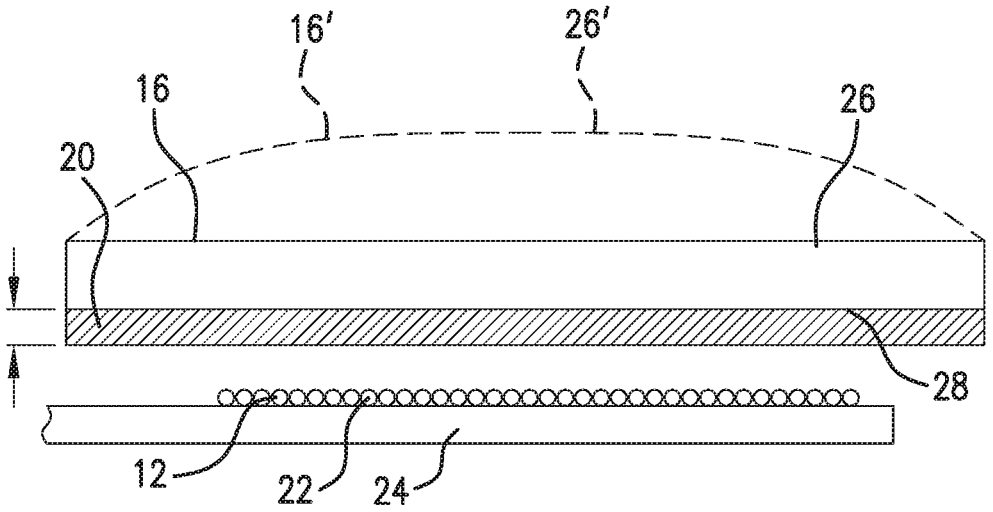
FIG. 2 depicts a sectional schematic view of magnetic pulse actuation arrangement of FIG. 1 with the workpiece deformed.

Movement of the workpiece 16 is adjustable. Such movement may be merely a positional change of the workpiece 16 without impacting another structure 18 (depicted in FIG. 1 as a casing), movement of the workpiece 16 towards the structure 18 to reduce the distance between the workpiece 16 and the structure 18, movement of the workpiece 16 towards the structure 18 to engage a feature (such as but not limited to slips) with the structure 18, movement of the workpiece 16 to impact the structure 18, and movement of the workpiece 16 to impact the structure 18 at such velocity that plastic deformation of the workpiece 16 occurs at an energy level where a weld is formed between the workpiece 16 and the structure 18. One embodiment of an outer surface 26' of the deformed workpiece 16', occurring after exposure to the magnetic field produced by the inductor 12, is illustrated in FIG. 2. Although not illustrated, the inner surface 28 of the deformed workpiece 16' would follow a similar curvature as the outer surface 26 in the deformed phase, with some differences occurring due to stretching at the outer surface 26. Careful control of the duration and magnitude of the magnetic pulse allows control of whether the movement of the work piece 16 will produce permanent deflect with no contact with another structure 18, where the workpiece 16 may simply be in contact with the other structure 18 such that movement of the workpiece 16 relative to the structure 18 is impeded but fluid passage is not prevented therebetween, where a sufficient pressure seal without a weld is created or where a fully or partially welded interface is created by an impact sufficient to cause a material jet and a solid state weld. In one non-limiting embodiment, the workpiece 16 may be a liner hanger secured to the structure 18, which is a casing, in a manner which enables axial loading.

As used herein, the term "pulse" relates to a magnetic field that is rapidly formed and will accelerate the workpiece 16 to a minimum velocity, wherein the term "pulse" itself is defined by its ability to cause the workpiece 16 to achieve the minimum velocity stated for an unspecified period of time. In one non-limiting embodiment, an excitation pulse frequency range is within +/−150% of the natural frequency of the workpiece 16 to be accelerated. Various actuations described herein are achievable using the pulse as defined for differing lengths of time such as installing a tool in the downhole environment, moving a portion of a tool (moving the workpiece), etc.

Generally applicable to all of the embodiments hereof, the pulse occurs pursuant to the use of the inductor 12 attached to the capacitor 14 that itself may be attached to a power source for recharging. Release of a workpiece-movement-inducing current (AC or DC) as the pulse defined above from the capacitor 14 (such as a capacitor bank) at a selected time generates a high-density magnetic field pulse that is coupled to the workpiece 16 placed in the vicinity thereof. An eddy current will consequently be produced in the workpiece 16 with a field orientation that opposes the current induced field hence providing a magnetic pressure that is capable of accelerating the workpiece 16 in a direction. Duration of a given pulse equates to distance of movement for a given system.

Figure 8:
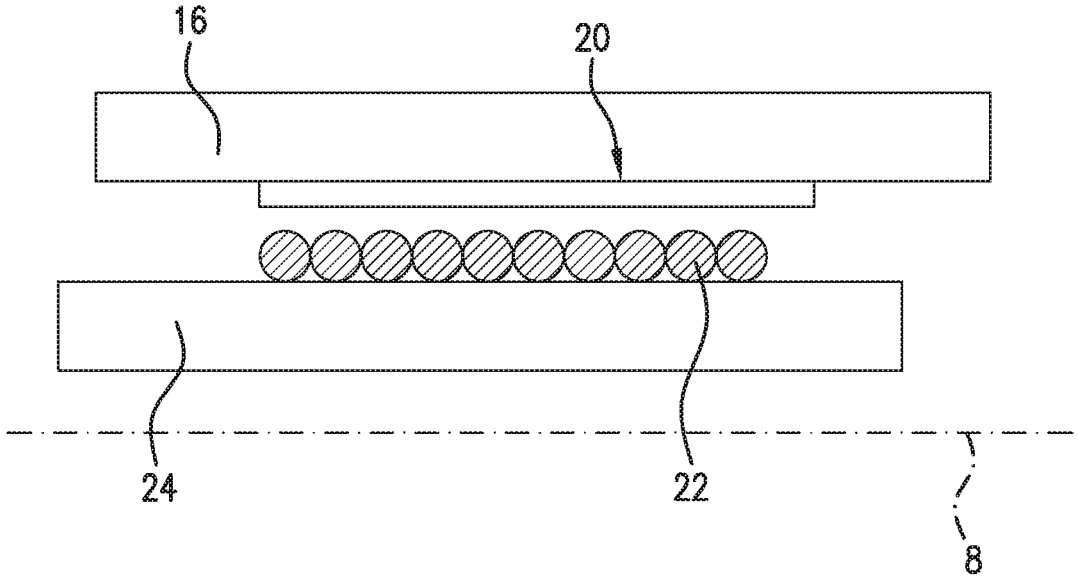
FIG. 8 depicts a sectional schematic view of a portion of an alternate embodiment of a magnetic pulse actuation arrangement.

Embodiments of the workpiece 16 described herein further include a layer 20 that faces the inductor 12. The layer 20 is formed from a material having a different magnetic permeability than the magnetic permeability of a material in which the workpiece 16 is formed. In one embodiment, the magnetic permeability of the material of the layer 20 is higher than the magnetic permeability of the material of the workpiece 16 so that the combination of the layer 20 and the workpiece 16 embodies an increased magnetic permeability as compared to that of the workpiece 16 alone, to enhance the effectiveness of electromagnetic forming or welding. In some embodiments, the workpiece 16 may be formed of, but not limited to, steel or titanium while the layer 20 may be formed of, but not limited to, copper or aluminum. Also, in any of the embodiments described herein, the layer 20 may include a single material that differs in magnetic permeability as compared to that of the workpiece 16, or may alternatively include a plurality of different materials, having one or more materials that differ in magnetic permeability from each other as well as from the workpiece 16. For example, the layer 20 may include a first layered area formed of a first material and a second layered area formed of a second material, the second material having a different magnetic permeability than the first material. The layer 20 may be welded, bonded, or otherwise secured to a surface of the workpiece 16 that faces the inductor 12. The layer 20 may include, but is not limited to, a coating, a sleeve, an insert, or other selectively disposed layer. The layer 20 is disposed along a portion of the workpiece 16. In some embodiments, the layer may be bonded to the workpiece 16, such as when the layer is a coating which may be bonded to the workpiece throughout the span of the layer. In other embodiments, the layer 20 may be otherwise secured or retained to the workpiece 16, such as by a threaded connection or selective bonding through adhesive or tack welding. In some embodiments, the layer 20 may be separable from the workpiece but held in place through shoulders and other mechanical capturing features. In one embodiment, the surface of the workpiece 16 that faces the inductor 12 is formed with a pocket 17 to receive the layer 20. In the illustrated embodiment of FIGS. 1 and 2, the layer 20 is formed on the inner surface 28, such that an inner diameter at the pocket 17 is greater than an inner diameter of the remainder of the workpiece 16. However, in an alternate embodiment, as shown in FIG. 8, the workpiece 16 is not provided with a pocket for the layer 20. In one embodiment, the layer 20 may be applied to the workpiece 16 in FIG. 8 by masking the intended unlayered area in order to apply the layer to the intended layered area. The sides of the layer 20 may be square as shown or could be tapered or rounded. Also, for illustrative purposes, the layer 20 in FIG. 8 is depicted as only spanning a portion of the workpiece 16, less than a full length of the workpiece 16. In one embodiment, to impart the change in permeability to the portion of the workpiece 16 that is desired to be moved, a longitudinal length of the layer 20 is the same as or greater than a longitudinal length of the coil 22 in the inductor 12. However, the layer 20 may be selectively applied to achieve the desired effect. The layer material, or another material 27 (see FIG. 1), may also be used at the intended weld area of the workpiece 16 to enhance the weld itself to the structure 18 by using a material that is easier to weld, and in the illustrated embodiment may be placed on the outer surface 26 of the workpiece 16, since some materials weld better than other ones. Using this effect, some explosive welding will fuse together materials that do not typically weld together well. The materials will fuse together as if they have been conventionally welded and with enough force to act similar to an explosive weld, but without the explosives that may be more difficult to control, particularly in a downhole environment.

In one embodiment, the layer 20 enhances the overall magnetic permeability of the workpiece 16 by using a more conductive layer on the interior surface of the workpiece 16, which increases the efficiency of expanding the workpiece 16 using electromagnet pulses. When the workpiece 16, such as the illustrated tubular, is expanded using electromagnetic pulsing, the electromagnetic field only affects a small depth (known as the skin depth) of the workpiece 16. By coating, welding, or otherwise applying a more conductive material (such as aluminum) to the workpiece 16, the material (such as steel) of the workpiece 16 which has a lower conductivity, can be expanded out more efficiently than a workpiece 16 not having the layer 20. In general, the more electrically conductive the layer 20 is, the more efficient the process will be, and the magnetic pulse from the inductor 12 is more efficient in the workpiece 16 having the layer 20.

While one embodiment has been described wherein the magnetic permeability of the material of the layer 20 is higher than the magnetic permeability of the material of the workpiece 16, in another embodiment the magnetic permeability of the material of the layer 20 may be lower than the magnetic permeability of the material of the workpiece 16 so that the combination of the layer 20 and the workpiece 16 decreases the magnetic permeability of the combination, as compared to the workpiece 16 alone. Such an embodiment may be employed when it is desirable to form certain areas of the workpiece 16 with decreased effectiveness of electromagnetic forming or welding. By comparison, areas of the workpiece 16 exposed to the magnetic field produced by the inductor 12 that are not coated with the layer 20 (which has lower magnetic permeability) will have greater effectiveness of electromagnetic forming or welding.

Figure 3:
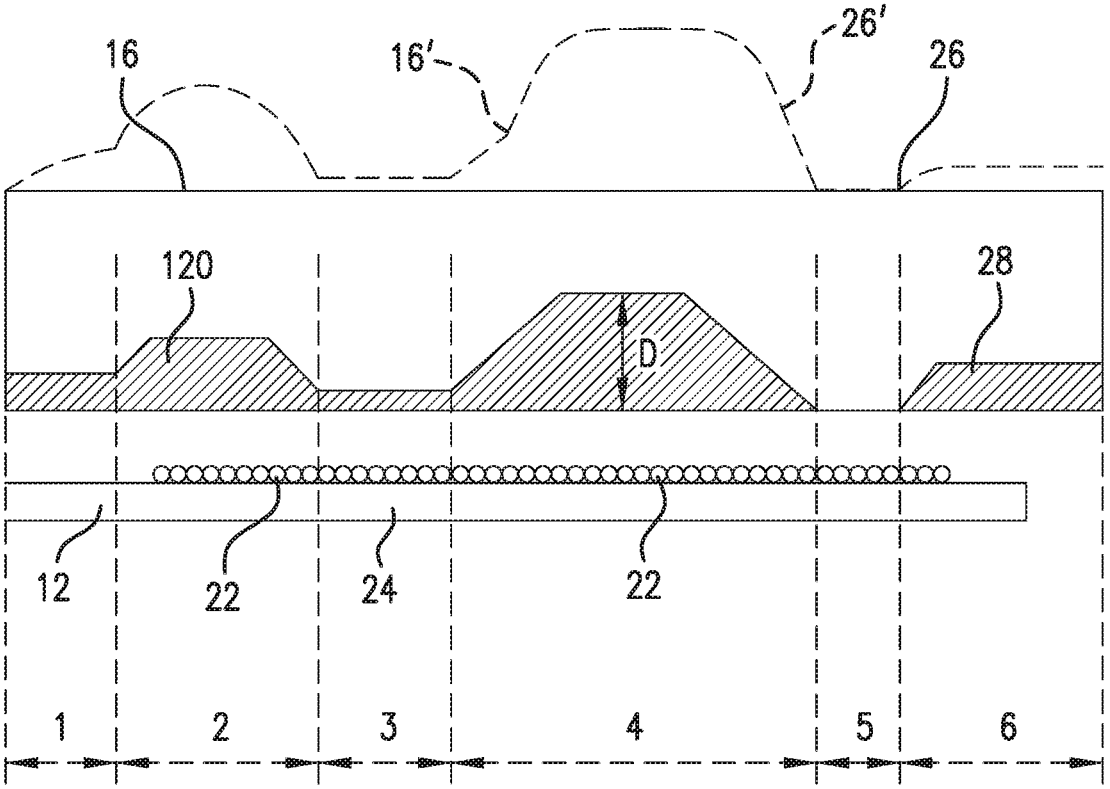
FIG. 3 depicts a sectional schematic view of an alternate embodiment of the magnetic pulse actuation arrangement with a multi-thickness layer variable along a longitudinal surface of the workpiece.

In the embodiments illustrated in FIGS. 1 and 2, the layer 20 is depicted as having a substantially constant depth (measured in a radial direction) across its length with respect to the longitudinal axis 8. In other embodiments, to selectively control the movement of the workpiece 16, the layer 20 may be applied to only certain areas of the workpiece 16, and/or may be applied with different thicknesses, and/or may be formed of materials having different magnetic permeabilities. With reference now to FIG. 3, one embodiment of a multi-thickness layer 120 is illustrated. The non-uniform, multi-thickness layer 120 provides a gradient effect on the deformation of the workpiece 16, as can be seen by the outer surface 26' of the deformed workpiece 16'. When the layer 120 is thinner than skin depth in some areas as compared to other areas, then the effect of field shaping the workpiece 16 can be accomplished because of the conductivity changes, without the need to attach a separate field shaper to a running tool. The surface (such as the inner surface 28) of the workpiece 16 can be milled or otherwise formed with the pocket 17 having variable depths to correspondingly accept the multi-thickness layer 120.

For descriptive purposes only, the multi-thickness layer 120 is illustrated as having different sections 1 through 6, with section 4 having a layer thickness D substantially equal to the skin depth of the workpiece 16. Again for illustrative purposes only, section 1 includes a layer having a thickness less than the thickness D; section 2 includes a layer having a thickness less than the thickness D but greater than the thickness in section 1; section 3 includes a layer having a thickness less than the thickness D, less than the thickness in section 1, and less than the thickness in section 2; section 4 includes a layer having the thickness D greater than the thickness in section 1, greater than the thickness in section 2, and greater than the thickness in section 3; section 5 does not include any layer, and section 6 includes a layer having a thickness approximately the same as the thickness in section 1, less than the thickness in section 2, greater than the thickness in section 3, and less than the thickness D in section 4. Thus, it can be seen that the multi-thickness layer 120 includes more than one section having layer thicknesses of differing depths, one or more of which are less than the skin depth of the workpiece 16. Also, each section having a different thickness may have the same or have a different longitudinal length as compared to other sections of the layer 120. Furthermore, the transitions between different thicknesses may be gradual as illustrated, but may alternatively be immediate.

When exposed to a magnetic field produced by the inductor 12, the deformation of the resulting deformed workpiece 16' will not be irregular and the extent of deformation will relatively follow the pattern of thicknesses of the multi-thickness layer 120. That is, when the section 4 has the greatest layer thickness within the multi-thickness layer 120 as shown, then the portion of the workpiece 16 carrying the section 4 of the layer 120 will correspondingly be deformed more than other portions of the workpiece 16. In the illustrated embodiment, the portions of the workpiece 16 corresponding to sections 1, 2, 3, 4, and 6, will be deformed in varying amounts proportional to the varying layer thicknesses in the sections 1, 2, 3, 4, and 6.

The amount of deformation experienced by the portion of workpiece 16 associated with section 5 depends on whether or not a coil 22 of the inductor 12 is provided adjacent the section 5. If one continuous coil is provided as shown in FIGS. 1 and 2, then the portion of workpiece 16 associated with section 5 may become deformed, as would a workpiece 16 not having any layer 20. That is, the workpiece 16 may still deform, but deform less than other portions of the workpiece 16 associated with sections having layers 20 that have higher magnetic permeability than a magnetic permeability of the material of the workpiece 16. However, if no deformation of the portion of workpiece 16 in section 5 is needed or desired, then the coil 22 need not be provided adjacent section 5. In one embodiment, this can be accomplished by a gap between two spaced coils 22 (where gap refers to the geometric space between the coils 22, although such coils 22 are still electrically connected).

As indicated in FIGS. 1-2, the inductor 12 includes a single coil 22. A single coil 22 may also be employed for the inductor 12 for use with the workpiece 16 having the multi-thickness layer 120 shown in FIG. 3. However, in alternate embodiments, the inductor 12 may instead include two or more coils 22 connected in series. Such an embodiment enables gaps to be created between any two adjacent coils 22, with the gaps sized to limit, and even prevent, the deforming of the workpiece 16 in selected portions of the workpiece 16. The multiple coils 22 connected in series eliminates the need to have magnetic flux acting on the entire length of the deforming portion of the workpiece 16 when it may not be necessary or desired. Further, the multiple coils 22 connected in series save energy by preventing current from passing through a coil where such a coil is not providing any benefit. Depending on the desired effect on the workpiece 16, the multiple coils 22 connected in series may either be cumulatively coupled or differentially coupled.

In yet another embodiment, multiple coils 22 in each section of the inductor 12 may be connected in parallel to enable the multi-thickness layer 120 to function based on conductivity. When the coils 22 are connected in parallel, even when provided with the same voltage, the current is different, and current is what drives the magnetic pressure in the parallel circuit. The different layer sections may have different electrical natural frequencies, which may require alterations of the frequency of the overall circuit. Each section would respond differentially based upon its own natural frequency and the circuit can be adjusted to match. That is, even if all the coils 22 are connected to the same energy source, the energy can be delivered to only activate those coils 22 for which their natural frequency are closest to the excitation frequency. Thus, a conductive change can be used to cause a different effect on the workpiece 16, even for a layer 20 having a uniform layer thickness, as shown in FIGS. 1 and 2, to create a different deforming effect across the layer.

The chosen circuit design of the coils 22, whether in series or in parallel, can be based on what is selected to drive the change in the workpiece, whether it is conductivity or magnetic permeability. The workpiece having the multi-thickness layer 120 will receive a differential load on each section having variable thickness even if a single coil 22 is used for all the sections of the multi-thickness layer 120, but the differential loading is enhanced/calibrated when the inductor 12 utilizes multiple coils 22 as described above.

Figure 4:
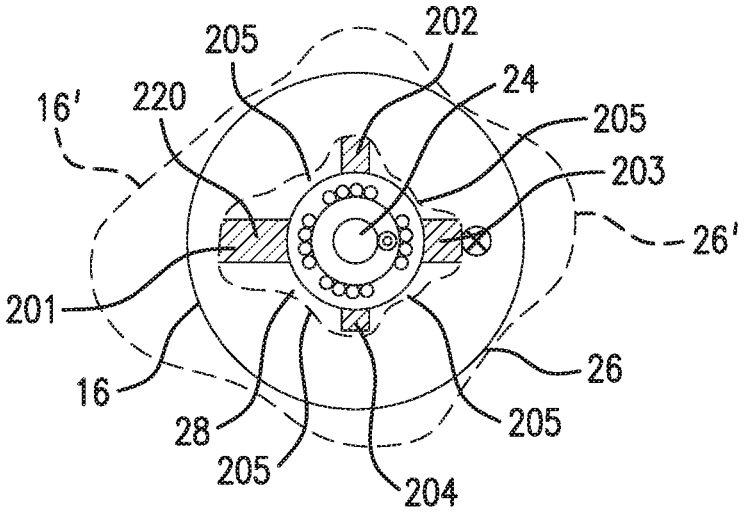
FIG. 4 depicts a cross-sectional schematic view of an alternate embodiment of the magnetic pulse actuation arrangement with a multi-thickness layer variable along a peripheral surface of the workpiece.

Turning now to FIG. 4, another embodiment of a multi-thickness layer 220 is shown. While the multi-thickness layer 120 includes variations in layer thickness with respect to the longitudinal axis 8 of the workpiece 16, the multi-thickness layer 220 includes variations in layer thickness with respect to a peripheral surface of the workpiece 16, such as the inner circumference as depicted in FIG. 4. For illustrative purposes only, the inner circumference of the workpiece 16 shown in FIG. 4 includes a first segment 201 where the layer 220 has a thickness approximately skin depth D, second and third segments 202 and 203 that have approximately the same depth which is less than depth D, and a fourth segment 204 that has a depth less than the layer 220 in segments 202 and 203. The layer 220 may include several separate segments, or the segments may be interconnected. The inner surface 28 of the workpiece 16 further includes segments 205 that do not have any layer 220. In the illustrated embodiment, the segments 205 are circumferentially interposed between segments 201 and 202, segments 202 and 203, segments 203 and 204, and segments 204 and 201. Less deformation of the outer surface 26' is seen in areas corresponding to segments 205. Thus, in this example, the deformed workpiece 16' is deformed non-uniformly across the outer surface 26' due to the selective placement of the multi-thickness layer 220 having various radial depths on the inner peripheral surface 28. While the workpiece 16 with multi-thickness layer 220 may have various applications, one use of the multi-thickness layer 220 is in attaching the deformed workpiece 16' to the structure 18 while still allowing passage of fluids longitudinally past the connection.

Figure 5:
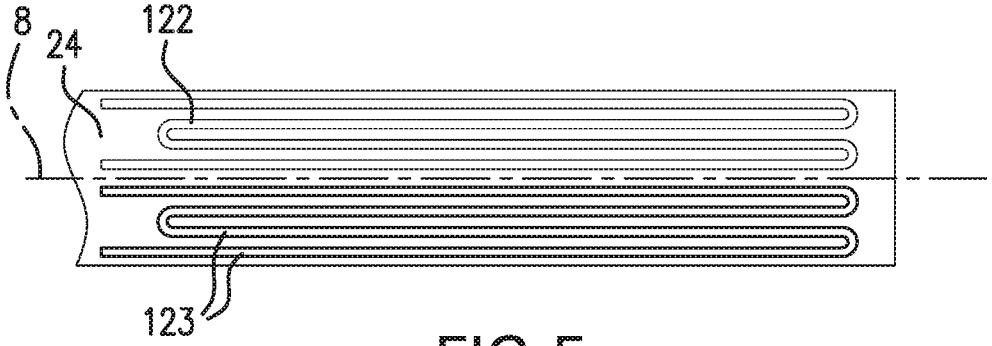
FIG. 5 depicts a side plan schematic view of an inductor for the magnetic pulse actuation arrangement of FIG. 4.

The coil(s) 22 of the inductor 12, for the embodiments of the workpiece 16 having the layer 20 and 120, are helically wrapped around the circumference of the mandrel 24, such that the coils 22 form a substantially tubular shape which shares the longitudinal axis 8 of the mandrel 24. While such coils 22 could also be employed to produce a magnetic field to move the workpiece 16 shown in FIG. 4, the inductor 12 for producing a magnetic field targeted to the peripherally spaced multi-thickness layer 220 is shown in FIG. 5. The inductor 12 shown in FIG. 5 includes coils 122 that have coil wires 123 extending substantially parallel to the longitudinal axis 8 of the mandrel 24, with the coils 122 peripherally arranged around the outer peripheral surface (circumference) of the mandrel 24, and peripherally spaced from each other around the mandrel 24. The coils 122 may also be limited to locations where the layer 220 is formed, with gaps between adjacent coils 122. Further, the above-described embodiments may be combined. For example, a workpiece 16 may be provided with one or more layers that are both variable in the longitudinal direction, such as layer 120, and variable in the circumferential direction, such as layer 220. Also, different coils 22, 122 can have different numbers of turns, different wire sizes, different materials, and different gauge values, depending on the goal of the system 10.

Figure 6:
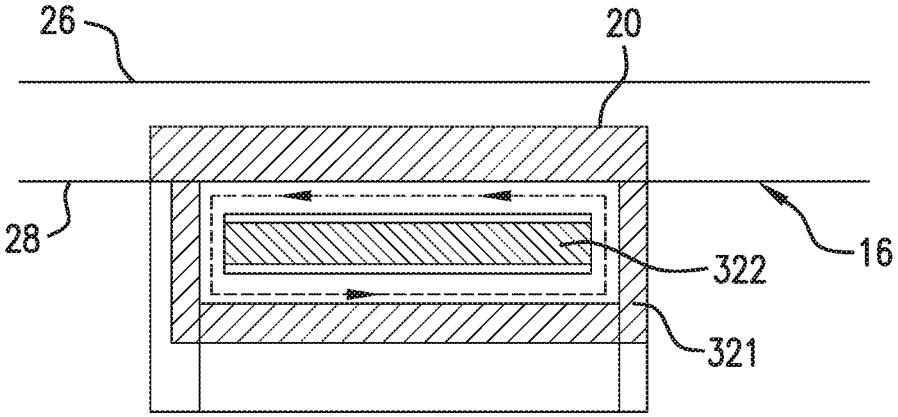
FIG. 6 depicts a sectional schematic view of a portion of an alternate embodiment of a magnetic pulse actuation arrangement.

In the above-described embodiments, current flows circumferentially around the mandrel 24, with the resultant current affecting the workpiece 16. In an alternate embodiment shown in FIG. 6, the circuit where the workpiece's current flows is through the longitudinal layer 20, but there is a closed loop circuit 322 where the current has to come back through and into the layer 20 through brushes or a plug 321, where the plug/brush 321 completes axial current flow of the workpiece layer 20.

The magnetic pulse actuation arrangement 10 having the layer 20 or multi-thickness layer 120 or 220 finds particular use in the oil field, downhole environment. In addition to the deformation of a workpiece 16, such as an inner tubular, into an outer structure 18, such as a casing, the magnetic pulse actuation arrangement 10 may be utilized in other applications. In different embodiments described herein, movement of the workpiece 16 as a result of the magnetic pulse may be in a directly radial direction whether inwardly or outwardly or movement may be directed axially or in any other direction selected and in which direction the pulse may be directed. As shown in the depiction of FIG. 1, movement that is radially outwardly directed. Movement directed radially is suitable for installing a number of downhole tools that utilize radial displacement such as liner hangers or casing patches (suitably illustrated in FIG. 1) where the workpiece 16 is the liner hanger or the casing patch and the outer structure 18 is a downhole structure such as an outer tubular, casing, or liner. In other embodiments, the workpiece 16 may include, for example, screens, fishing tools, couplings, plugs, etc.

Figure 7:
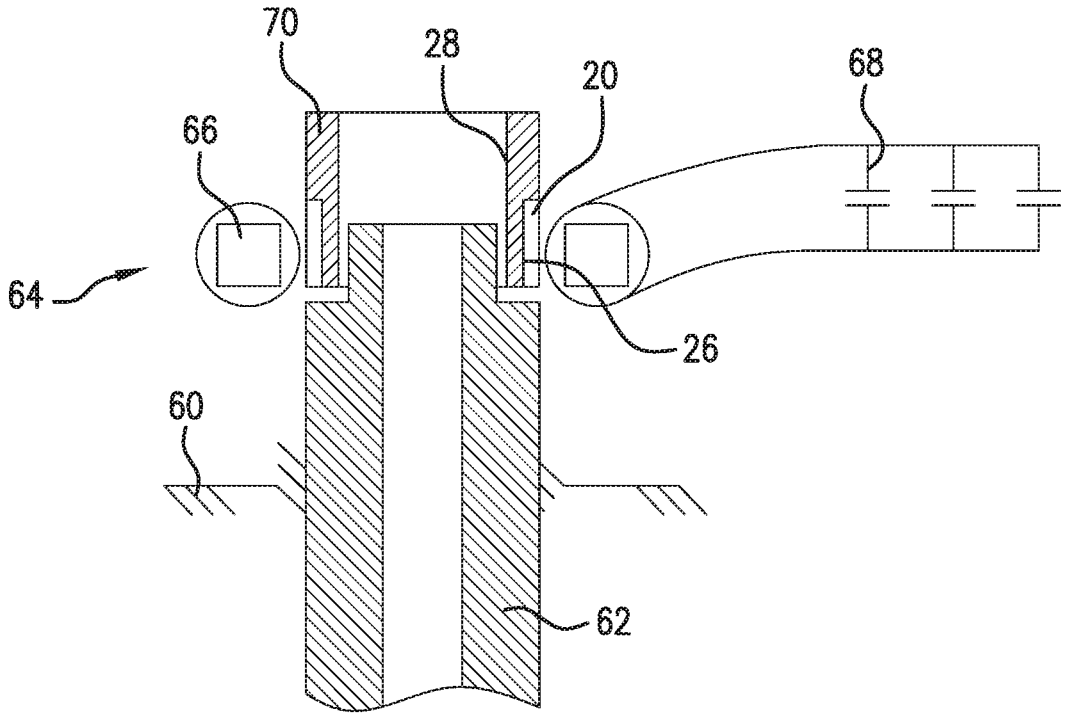
FIG. 7 depicts a sectional schematic view of an alternate embodiment of a magnetic pulse actuation arrangement employed as a coupling arrangement.

Referring to FIG. 7, a schematic cross section view of a coupling operation is illustrated, as another embodiment for the application of a magnetic pulse actuation arrangement having layer 20, 120, 220. A rig floor 60 is shown about a tubular 62 being advanced into the hole. A magnetic pulse actuator 64 includes an inductor 66 powered by a capacitor 68 similar to FIG. 1 that is positioned about a workpiece 70, which in this iteration is a coupling to connect sequential tubulars together to create a string. The magnetic pulse accelerates the coupling 70 into contact with the tubular 62 at sufficient velocity to create a connection, whether that be merely an interference fit or a weld as desired by the operator. Layer 20, whether with uniform or variable thickness, could be on OD for accelerating radially inward movement of the workpiece 70 towards the tubular 62.

Thus, some embodiments described herein employ a high permeability material layer 20, 120, 120, which may be disposed on the workpiece, such as welded or bonded to a surface (such as the outside or inside of a tubular body) of the workpiece (a tool) to increase the magnetic permeability of the base tubular to enhance the effectiveness of electromagnetic forming or welding. The layer material, or another material 27, can also be used to enhance the weld itself by using a material that is easier to weld on the outside of the tubular. The overall magnetic permeability of a tubular can be changed and/or enhanced by using a more conductive layer 20, 120, 220 on the OD or ID of the tubular. This increases the efficiency of expanding or compressing it using electromagnet pulses. When a tubular is expanded using electromagnetic pulsing, the electromagnetic field only affects a small depth (known as skin depth) of the tubular. By coating or welding a more conductive material (such as aluminum) to the depth of the skin depth or greater of a workpiece material (such as steel) which has a lower conductivity, can be expanded out at a much faster and efficient rate than steel alone. In general, the more electrically conductive the material is, the more efficient the process will be. The layer can be applied to the OD to enhance the compressibility. The layer 27 could also be applied to enhance the weldability of the material. Another alternate method would be to apply the layer at different thicknesses and/or different materials having different magnetic permeabilities. This enables a field shaping effect which changes and/or intensifies the magnetic field in varying degrees depending on the thicknesses of the layer. Another alternate method is to create different layers and thicknesses of layers to control the magnetic field which controls the location, speed, and effect of the radial expansion. If a thicker piece of layer (having greater magnetic permeability) is utilized, the pressure will be increased in response to the magnetic pulse. The thicker layer is also more electrically conductive than the workpiece, so the pressure will increase because the current will also increase. This creates selective deformation patterns because the workpiece will become more deformed where you have more pressure.

Use of the layered magnetic pulse actuation arrangement reduces the amount of energy needed to be carried downhole to move a workpiece/tool towards another structure, such as expanding a tubular into a parent casing. Use of the different layer thicknesses/layers to control the magnetic fields also eliminates the need to run a field shaper downhole with the EM coil on the running string, which results in fewer parts to build, maintain, and carry downhole.

Set forth below are some embodiments of the foregoing disclosure:

Embodiment 1

A magnetic pulse actuation arrangement configured for use in a downhole system, the arrangement including: a workpiece; a layer placed along a portion of the workpiece, the layer having a different magnetic permeability than the workpiece; and, an inductor including a coil and configured to deliver a magnetic pulse to the workpiece to urge the workpiece in a direction, the layer facing the coil.

Embodiment 2

The arrangement as in any prior embodiment or combination of embodiments, wherein the layer has a greater magnetic permeability than a magnetic permeability of the workpiece.

Embodiment 3

The arrangement as in any prior embodiment or combination of embodiments, wherein the layer has a different conductivity than a conductivity of the workpiece.

Embodiment 4

The arrangement as in any prior embodiment or combination of embodiments, wherein the layer is on one of an interior surface or exterior surface of the workpiece, and the other of the interior surface or exterior surface of the workpiece is configured to be urged toward a structure in response to the magnetic pulse.

Embodiment 5

The arrangement as in any prior embodiment or combination of embodiments, wherein the layer has a variable thickness including a first thickness and a second thickness different than the first thickness.

Embodiment 6

The arrangement as in any prior embodiment or combination of embodiments, wherein a first layered area having the first thickness is formed of a first material and a second layered area having the second thickness is formed of a second material, the second material having a different magnetic permeability than the first material.

Embodiment 7

The arrangement as in any prior embodiment or combination of embodiments, wherein the workpiece has a longitudinal axis, and a section of the layer having the first thickness is longitudinally displaced from a section of the layer having the second thickness.

Embodiment 8

The arrangement as in any prior embodiment or combination of embodiments, wherein a section of the layer having the first thickness is circumferentially displaced from a section of the layer having the second thickness.

Embodiment 9

The arrangement as in any prior embodiment or combination of embodiments, wherein the coil is a first coil arranged adjacent to a section of the layer having the first thickness, and further comprising a second coil arranged adjacent to a section of the layer having the second thickness.

Embodiment 10

The arrangement as in any prior embodiment or combination of embodiments, wherein the first and second coils are connected in series or in parallel.

Embodiment 11

The arrangement as in any prior embodiment or combination of embodiments, wherein the first and second coils are wrapped around a mandrel.

Embodiment 12

The arrangement as in any prior embodiment or combination of embodiments, wherein the first and second coils are wrapped longitudinally with respect to an axis of a mandrel.

Embodiment 13

The arrangement as in any prior embodiment or combination of embodiments, wherein the coil is a first coil arranged adjacent to a first section of the layer, and further comprising a second coil arranged adjacent to a second section of the layer, wherein the coils are electrically connected and separated by a gap.

Embodiment 14

The arrangement as in any prior embodiment or combination of embodiments, wherein the coil is a first coil arranged adjacent to the layer, and further comprising a second coil arranged adjacent to a non-layered portion of the workpiece.

Embodiment 15

The arrangement as in any prior embodiment or combination of embodiments, wherein the layer has a uniform thickness.

Embodiment 16

The arrangement as in any prior embodiment or combination of embodiments, further comprising a plug or brush configured to form a closed loop circuit with the layer and complete an axial current flow of the layer.

Embodiment 17

The arrangement as in any prior embodiment or combination of embodiments, wherein the workpiece is a downhole tubular and further comprising an inner or outer tubular positioned interiorly or exteriorly of the downhole tubular, the downhole tubular urged towards the inner or outer tubular in response to the magnetic pulse.

Embodiment 18

The arrangement as in any prior embodiment or combination of embodiments, wherein the layer is a first layer, and further comprising a second layer disposed on a portion of the workpiece configured to contact a structure, the second layer formed of a material to enhance a bond between the structure and the workpiece.

Embodiment 19

The arrangement as in any prior embodiment or combination of embodiments, wherein the layer includes a first layered area formed of a first material and a second layered area formed of a second material, the second material having a different magnetic permeability than the first material.

Embodiment 20

The arrangement as in any prior embodiment or combination of embodiments, wherein the layer is a coating.

Embodiment 21

A method of installing a workpiece in a downhole system, the method including: selectively applying a layer to a portion of the workpiece, the layer having a greater magnetic permeability than the workpiece; running the workpiece to a target location with respect to a downhole structure; creating a magnetic pulse using an inductor, the layer facing the inductor; and urging the workpiece in a direction relative to a structure with the magnetic pulse.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A magnetic pulse actuation arrangement configured for use in a downhole system, the arrangement including:

a workpiece defining a downhole tubular and one of an inner tubular and an outer tubular positioned relative to the downhole tubular;

a layer placed along a portion of the workpiece, the layer having a different magnetic permeability than the workpiece; and, an inductor including a coil and configured to deliver a magnetic pulse to urge the downhole tubular toward the one of the inner tubular and the outer tubular, the layer facing the coil.

2. The arrangement of claim 1, wherein the layer has a greater magnetic permeability than a magnetic permeability of the workpiece.

3. The arrangement of claim 1, wherein the layer has a different conductivity than a conductivity of the workpiece.

4. The arrangement of claim 1, wherein the layer is on one of an interior surface or exterior surface of the workpiece, and the other of the interior surface or exterior surface of the workpiece is configured to be urged toward a structure in response to the magnetic pulse.

5. The arrangement of claim 1, wherein the layer has a variable thickness including a first thickness and a second thickness different than the first thickness.

6. The arrangement of claim 5, wherein a first layered area having the first thickness is formed of a first material and a second layered area having the second thickness is formed of a second material, the second material having a different magnetic permeability than the first material.

7. The arrangement of claim 5, wherein the workpiece has a longitudinal axis, and a section of the layer having the first thickness is longitudinally displaced from a section of the layer having the second thickness.

8. The arrangement of claim 5, wherein a section of the layer having the first thickness is circumferentially displaced from a section of the layer having the second thickness.

9. The arrangement of claim 5, wherein the coil is a first coil arranged adjacent to a section of the layer having the first thickness, and further comprising a second coil arranged adjacent to a section of the layer having the second thickness.

10. The arrangement of claim 9, wherein the first and second coils are connected in series or in parallel.

11. The arrangement of claim 9, wherein the first and second coils are wrapped around a mandrel.

12. The arrangement of claim 9, wherein the first and second coils are wrapped longitudinally with respect to an axis of a mandrel.

13. The arrangement of claim 1, wherein the coil is a first coil arranged adjacent to a first section of the layer, and further comprising a second coil arranged adjacent to a second section of the layer, wherein the coils are electrically connected and separated by a gap.

14. The arrangement of claim 1, wherein the coil is a first coil arranged adjacent to the layer, and further comprising a second coil arranged adjacent to a non-layered portion of the workpiece.

15. The arrangement of claim 1, wherein the layer has a uniform thickness.

16. The arrangement of claim 1, further comprising a plug or brush configured to form a closed loop circuit with the layer and complete an axial current flow of the layer.

17. The arrangement of claim 1, wherein the layer is a first layer, and further comprising a second layer disposed on a portion of the workpiece configured to contact a structure, the second layer formed of a material to enhance a bond between the structure and the workpiece.

18. The arrangement of claim 1, wherein the layer includes a first layered area formed of a first material and a second layered area formed of a second material, the second material having a different magnetic permeability than the first material.

19. The arrangement of claim 1, wherein the layer is a coating.

20. A method of installing a downhole tubular in a downhole system, the method comprising:

selectively applying a layer to a portion of the downhole tubular, the layer having a greater magnetic permeability than the downhole tubular;

running the downhole tubular to a target location with respect to a downhole structure;

creating a magnetic pulse using an inductor, the layer facing the inductor; and urging the downhole tubular toward one of an inner tubular and an outer tubular with the magnetic pulse.

* * * * *